US011306495B2

(12) United States Patent
Stephan

(10) Patent No.: US 11,306,495 B2
(45) Date of Patent: Apr. 19, 2022

(54) SYSTEM, METHOD AND APPARATUS FOR FALL PROTECTION OF WORKERS AT A CONSTRUCTION SITE

(71) Applicant: Safe Construction Fall Protection, LLC, Florence, TX (US)

(72) Inventor: J. Eric Stephan, Florence, TX (US)

(73) Assignee: Safe Construction Fall Protection, LLC, Florence, TX (US)

( * ) Notice: Subject to any disclaimer, the term of this patent is extended or adjusted under 35 U.S.C. 154(b) by 550 days.

(21) Appl. No.: 16/424,223

(22) Filed: May 28, 2019

(65) Prior Publication Data

US 2019/0368211 A1 Dec. 5, 2019

Related U.S. Application Data

(60) Provisional application No. 62/677,836, filed on May 30, 2018.

(51) Int. Cl.
*E04G 21/32* (2006.01)
*A62B 35/00* (2006.01)

(52) U.S. Cl.
CPC ..... *E04G 21/3204* (2013.01); *A62B 35/0056* (2013.01); *A62B 35/0068* (2013.01)

(58) Field of Classification Search
CPC .. E04G 7/24; E04G 7/06; E04G 5/061; E04G 5/00; E04G 5/14; E04G 5/06; E04G 21/3204; E04G 21/3295; E04G 21/3276; E04G 21/3223; A62B 35/0056; A62B 35/0068; A62B 35/0043
See application file for complete search history.

(56) References Cited

U.S. PATENT DOCUMENTS 3,662,993 A * 5/1972 Lionetto ..... E04G 7/22 256/65.13
6,412,598 B1 * 7/2002 Mackinnon ..... F16B 9/01 182/3

(Continued)

FOREIGN PATENT DOCUMENTS

WO WO-9840632 A1 * 9/1998 ..... A47H 1/022

OTHER PUBLICATIONS

"Super Anchor Safety, Fall Protection Equipment", https://superanchor.com/?page_id=32, 5 pages.

(Continued)

*Primary Examiner* — Brian D Mattei
*Assistant Examiner* — Kathleen M. McFarland

(57) ABSTRACT

A fall protection system can include towers configured to be coupled together with horizontal lifelines. Each tower can have a base removably coupled to a bottom of the frame. A lower slip sleeve can be slidably coupled to the base. The lower slip sleeve can have an elongate opening extending therethrough. An internal piece can be slidably received in the elongate opening and coupled to the lower slip sleeve. In addition, an upper slip sleeve can be coupled to an exterior of the internal piece such that the upper slip sleeve is not movable relative to the internal piece. Further, a mount plate can be slidably coupled to an exterior of the upper slip sleeve and mounted to a top of the frame. Finally, a stanchion can be slidably received in the upper elongate opening and coupled to the upper slip sleeve.

19 Claims, 10 Drawing Sheets

(56) References Cited

U.S. PATENT DOCUMENTS

| | | | | |
|---|---|---|---|---|
| 7,802,773 | B2 * | 9/2010 | Murphy | E04G 21/3223 256/65.14 |
| 2005/0284693 | A1 * | 12/2005 | Rhodes | E04G 5/001 182/3 |
| 2006/0237263 | A1 * | 10/2006 | Gaines | E04G 21/3214 182/113 |
| 2008/0041660 | A1 * | 2/2008 | Marini | A62B 35/0056 182/3 |
| 2011/0315474 | A1 * | 12/2011 | Wiser | A62B 35/0056 182/3 |
| 2012/0298444 | A1 * | 11/2012 | O'Reilly | A62B 35/0056 182/3 |

OTHER PUBLICATIONS

"Safety Pole, User Instruction Manual, Safety Pole and Horizontal Lifeline System", https://www.safetypole.com/files/131815889.pdf, Rev Jun. 1, 2019, 14 pages.

* cited by examiner

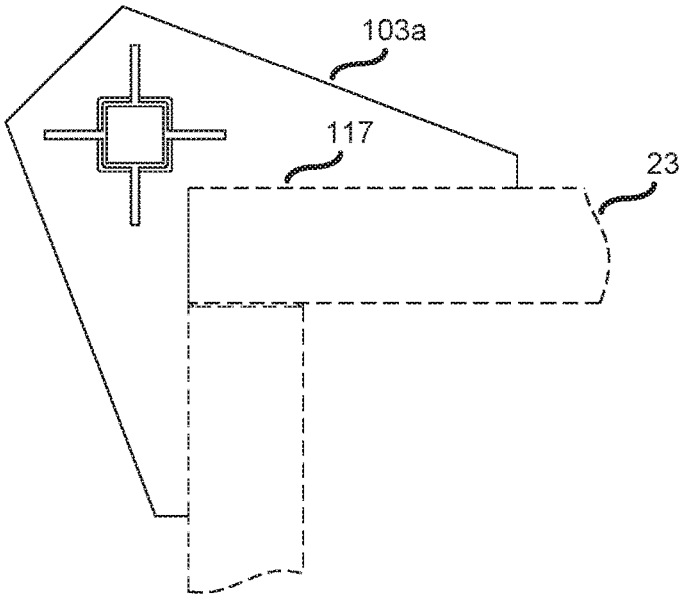
FIG. 5B
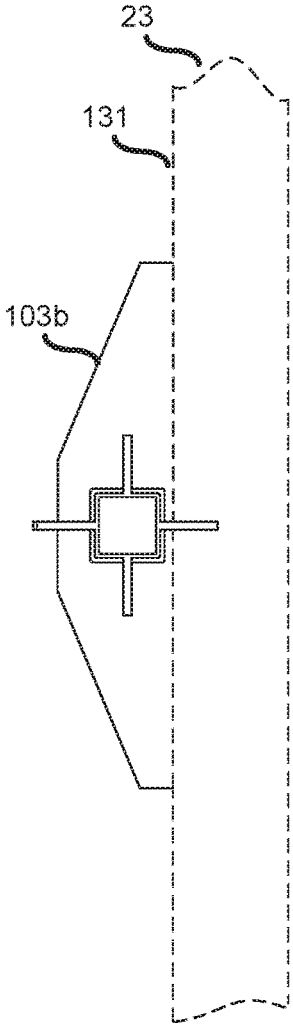
FIG. 5C
FIG. 5D
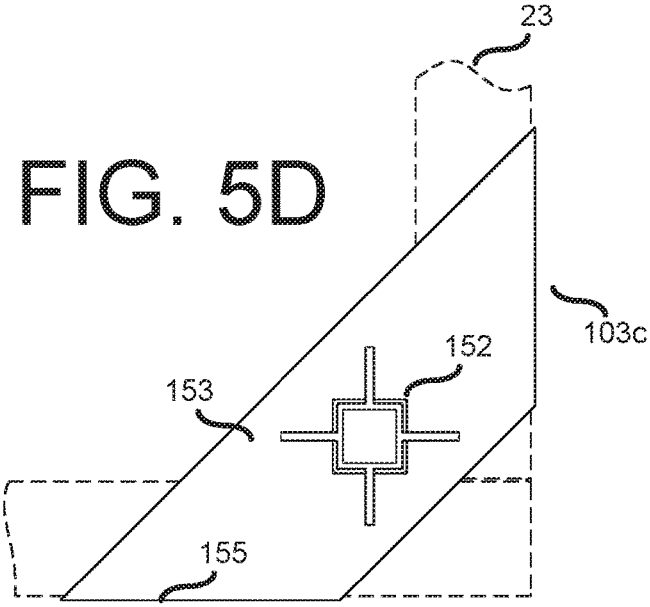

SYSTEM, METHOD AND APPARATUS FOR FALL PROTECTION OF WORKERS AT A CONSTRUCTION SITE

CROSS-REFERENCE TO RELATED APPLICATION AND CLAIM OF PRIORITY

This application claims priority under 35 U.S.C. § 119(e) to U.S. Provisional Patent Application No. 62/677,836 filed on May 30, 2018. The above-identified provisional patent application is hereby incorporated by reference in its entirety.

TECHNICAL FIELD

The present invention relates in general to construction safety and, in particular, to a system, method and apparatus for fall protection of workers at construction job sites.

BACKGROUND

Construction industry stakeholders, including, without limitation, residential and commercial builders, framers and insurers, are concerned about protecting workers from falls from unfinished structures (for example, structures under construction or being repaired). Despite helpful regulation and improvements in safety equipment, numerous opportunities for reducing the incidence of fall-related injuries and deaths associated with building construction remain. Fatalities from falls typically are a leading cause of workplace deaths in construction. Accordingly, improvements in fall protection of workers at construction sites continue to be a source of technical challenges and improvement in the art.

SUMMARY

Embodiments of a system, method and apparatus for the fall protection of workers at construction sites are disclosed. For example, the fall protection system provides improved protection for workers from falls at a worksite for an unfinished structure, such as a dwelling or building formed with a wood or metal frame. Embodiments of the systems according to this disclosure include one or more towers configured to be coupled together with a horizontal lifeline. In certain embodiments, each tower has a base configured to be removably coupled to a bottom of the wood or metal frame. A lower slip sleeve is, in various embodiments, configured to be slidably coupled to the base. The lower slip sleeve has an elongate opening extending substantially therethrough. According to some embodiments, an internal piece is configured to be slidably received in the elongate opening and coupled to the lower slip sleeve. In some embodiments, an upper slip sleeve is coupled to an exterior of the internal piece such that the upper slip sleeve is not movable relative to the internal piece. The upper slip sleeve has, in certain embodiments, an upper elongate opening extending to the internal piece. Further, a mount plate is, in various embodiments, configured to be slidably coupled to an exterior of the upper slip sleeve and mounted to a top of the wood or metal frame. Finally, a stanchion is, in certain non-limiting examples described herein, configured to be slidably received in the upper elongate opening and coupled to the upper slip sleeve. The stanchion is, in various embodiments, configured to support at least one end of the horizontal lifeline.

In other embodiments, a method of providing fall protection on levels of a building that is under construction is disclosed. The method can include constructing an initial level of the building with a wood or metal frame, and installing a fall protection system to the initial level of the frame. The method can include further constructing and framing the frame to a second level of the frame above the initial level of the frame while providing fall protection for construction workers with the fall protection system. Thereafter, the method can include uninstalling the fall protection system from the initial level of the frame. Further, the method can include installing the fall protection system to the second level of the frame, such that the fall protection system is not mounted to any portion of the initial level of the frame. The method can further include constructing and framing the frame to a third level, or higher level, of the frame above the second level of the frame while providing fall protection for construction workers with the fall protection system.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

FIGS. 5B-5D illustrate components of a fall protection system according to some embodiments of this disclosure.

The use of the same reference symbols in different drawings indicates similar or identical items.

DETAILED DESCRIPTION

Figure 1A:
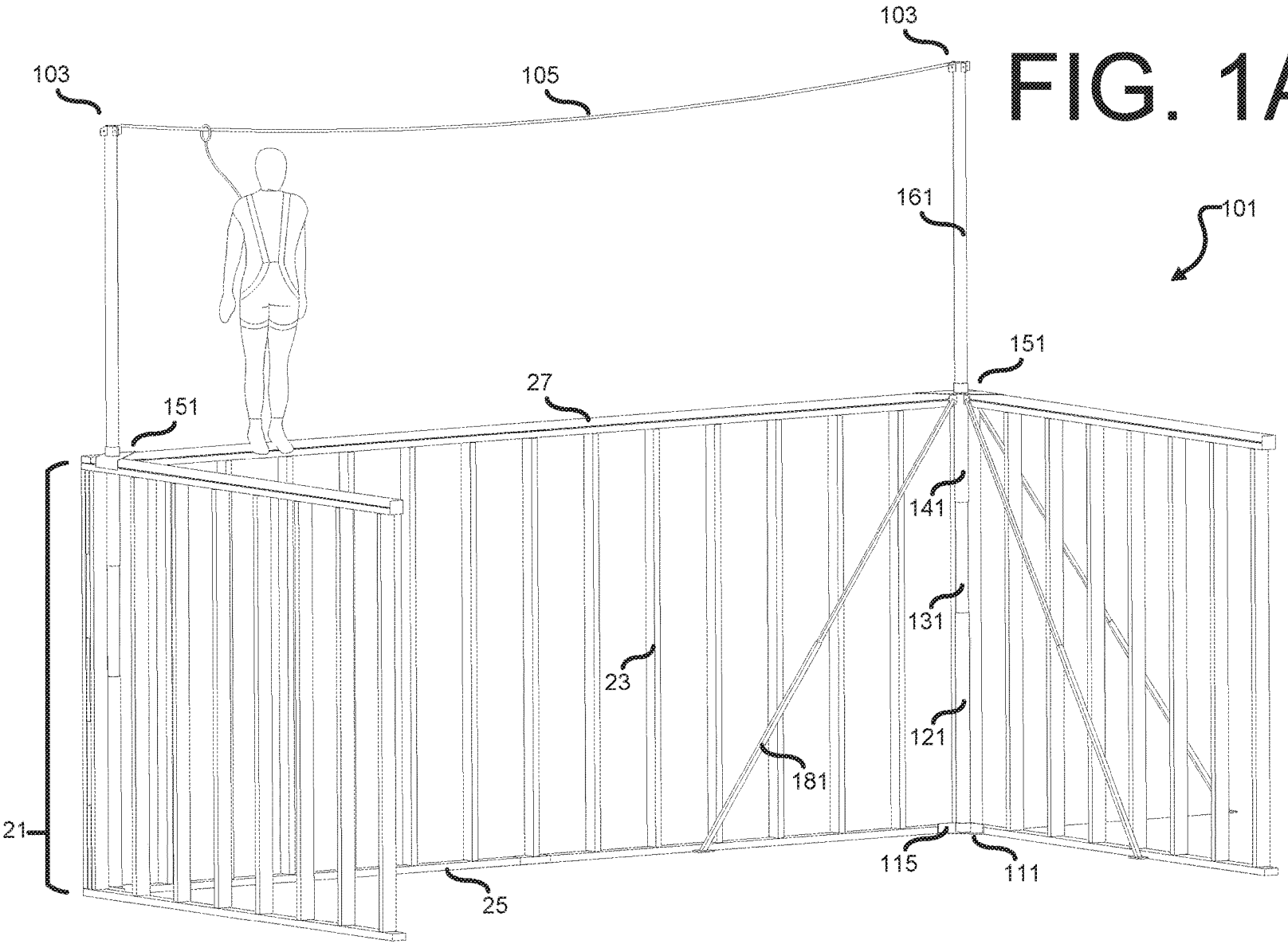
FIG. 1A illustrates a fall protection system according to certain embodiments of this disclosure as deployed on the first floor of a building frame under construction.

Before any embodiments according to this disclosure are explained in detail, it is to be understood that embodiments according to the present disclosure are not limited by the details of construction and the arrangement of components set forth in the following description or illustrated in the drawings.

FIGS. 1-6 illustrate some embodiments of a system, method and apparatus for a fall protection system 101 according to the present disclosure. The fall protection system 101 provides support for a lifeline 105 to which can be tethered, such that the tether and lifeline can prevent a human worker from contacting the ground or a hard surface below as a result of a fall from an unfinished structure 21 comprising a wood or metal frame 23. According to various embodiments, wood or metal frame 23 comprises structural members (for example, wood or metal studs) of unfinished structure 21. In some embodiments, system 101 includes one or more towers 103 (for example, multiple instances of tower 103, as shown in the explanatory examples of FIGS. 1A and 1B). Towers 103 can be configured to be coupled together with one or more lifelines 105, such as the lifeline 105 shown in FIG. 1A. According to various embodiments, lifeline 105 comprises a section of material with high tensile strength and suitable abrasion resistance (for example, steel cable or climbing rope) with one or more eye ends, crimped loops or other terminal fittings for attachment to tower 103.

According to certain embodiments, tower 103 comprises a plurality of tubing components forming stanchions and sleeves as discussed herein. Referring to the non-limiting examples of FIGS. 1-6, square-shaped cross-sectional bodies are shown, but embodiments according to the present disclosure are not limited thereto and tower 103 can be constructed from components with circular, obround and other cross-sectional shapes. According to various embodiments, tower 103 includes a bottom plate or base 111 that is configured to be removably coupled, such as with fasteners, to a portion (e.g., a bottom 25) of the wood or metal frame 23. In addition or alternatively, the base 111 can be mounted to the foundation of the unfinished structure 21 with fasteners. The base 111 is, in certain embodiments, secured to the foundation with cast-in-place anchor bolts, at 4-foot centers. In applications, where the floor of the installation site permits the use of fasteners (for example, floors constructed using wood and/or metal decking), base 111 is, in some embodiments, secured to the decking and joists with one or more fasteners.

According to certain embodiments, base 111 comprises a vertical sleeve 112 (FIGS. 3 and 6) in which a lower slip sleeve 121 is configured to be mounted. In some embodiments, the lower slip sleeve 121 is configured to be slidably coupled to the base 111. As illustrated in the non-limiting example of FIG. 6, the lower slip sleeve 121 is coupled to the base 111 (and other components can be reversibly mechanically coupled) with one or more fasteners, (for example, fasteners which can be readily installed and removed in the field, such as removable detent pins or clamps). Removable detent pins are, in various embodiments, configured to selectively reversibly couple or mount two or more components of system 101 together. The lower slip sleeve 121 can have a hollow internal cavity, such as an elongate opening 123 (FIG. 2), extending substantially therethrough.

According to some embodiments, tower 103 further includes an internal piece 131, such as a rod or section of square tubing, which can be configured to be slidably received in the elongate opening 123. The internal piece 131 can, in various embodiments be coupled to the lower slip sleeve 121, such as with a removable detent pin.

In various embodiments, tower 103 also includes an upper slip sleeve 141 coupled to an exterior of the internal piece 131. Upper slip sleeve 141 can be permanently mounted to (for example, by welding or riveting) and not movable relative to the internal piece 131. The upper slip sleeve 141 can include an upper elongate opening 143 (as shown, for example in FIG. 2) that extends to the internal piece 131 located inside the upper slip sleeve 141.

In addition, the tower 103 is, in various embodiments, coupled to a mount plate 151. The tower 103 can be configured to be slidably coupled or extend through an aperture (e.g., hole 152 in FIG. 4) in the mount plate 151. In particular, the hole 152 can receive an exterior of the upper slip sleeve 141. The mount plate 151 can be mounted, such as with fasteners, to a portion (e.g., a top 27) of the wood or metal frame 23. The mount plate 151 can be attached to a top plate, and the upper slip sleeve 141 can be secured to the mount plate 151 with fasteners. In some embodiments, upper slip sleeve 141 is secured to mount plate 151 with fasteners suitable for field use, rather than nails. Although the mount plate 151 is shown in the illustrative examples of FIGS. 1A, 1B and 4 as mounted to the top horizontal surface of the wood or metal frame 23, embodiments according to this disclosure are not limited thereto, and mount plate 151 can also be mounted to vertical side surfaces of the wood or metal frame 23. FIGS. 5A-D, 7 and 8 illustrate examples of mount plates 151 mounted to the side(s) of structures. According to various embodiments, mount plates 151 which can be side-mounted versions can facilitate installation of joists, joist trusses, rafters or roof truss structures on top of the wood or metal frame 23.

Embodiments of the fall protection system 101 can include one or more stanchions 161. As shown in the non-limiting example of FIG. 2, each stanchion 161 can be configured to be slidably received in the upper elongate opening 143 and coupled to the upper slip sleeve 141, such as with a removable detent pin. The stanchion 161 can be configured to support an end of at least one of the lifelines 105. According to various embodiments, the upper end of each stanchion 161 includes hardware (for example, carabiners, clips or other hardware) to couple with and secure a plurality of additional lifelines 105. Further examples of hardware for coupling lifelines 105 to stanchion 161 include, without limitation, one or more brackets or eyebolts.

According to various embodiments of fall protection system 101, internal piece 131, upper slip sleeve 141, mount plate 151, and stanchion 161 are configured one or more of the above-referenced components can be moved to adjust the height of the apparatus and lifeline 105. According to various embodiments, the internal piece 131, the upper slip sleeve 141, the mount plate 151, and the stanchion 161 can be adjusted with respect to lower slip sleeve 121 to define a desired vertical elevation of each of the towers 103. According to certain embodiments, for example, embodiments shown in the illustrative example of FIG. 2, each tower 103 has a plurality (for example, at least three) settings for vertical elevation, defined, in some instances, by the position of through holes in one or more of slip sleeve 121, internal piece 131, or upper slip sleeve 141. For example, a first vertical elevation from the base 111 to the mount plate 151 of each tower 103 is 8 feet. Like many dimensions in the construction industry, the distance "8 feet" is a nominal measurement, and can be interpreted to encompass about 8 feet or substantially 8 feet. In another example, a second vertical elevation from the base 111 to the mount plate 151 of each tower 103 is about 9 feet. Embodiments also can include a third vertical elevation from the base 111 to the mount plate 151 of each tower 103 that is substantially 10 feet. Accordingly, these styles of vertical stanchion systems can include a receiver-type arrangement at the top that permits the upper vertical stanchion to be positioned about two feet into the section below it. The upper vertical stanchion 161 can have nominal heights above the corner or intermediate brackets of the wood or metal frame 23 of (for example) about 6 feet or about 7 feet, depending upon user preference and job site conditions. According to various embodiments, upper vertical stanchion 161 can have nominal heights above the corner or intermediate brackets of wood or metal frame 23 of greater than 7 feet.

According to certain embodiments, fall protection system 101 can be implemented without tensioning cables or rigid support between vertical elements of the system and the ground to help resist cantilevering of the vertical components from loads on lifeline 105. Accordingly, by ensuring sufficient structural strength without the use of tensioning cables, guy wires, or rigid supports certain embodiments according to this disclosure can be implemented in a wider variety of contexts (for example, in tighter spaces or where the surrounding ground cannot hold tensioning cables). Moreover, in various embodiments, fall protection system 101 is not fastened to any portion of a concrete foundation of the unfinished structure 21. Surprisingly, in certain embodiments, the structural integrity needed to support lifeline 105 on stanchions 161 can be achieved by coupling fall protection system 101 to the wood or metal frame 23 of the unfinished structure 21 to secure it to the unfinished structure 21. Further, and as described herein, towers 103 of fall protection system 101 can be attached to one or more of an interior of the unfinished structure 21, and concave corners of the wood or metal frame 23, interior, concave corners of the wood or metal frame. Accordingly, embodiments of fall protection system 101 can provide flexible, robust solutions for supporting lifelines across a wide variety of site geometries, thereby providing workers with improved fall protection.

Figure 5A:
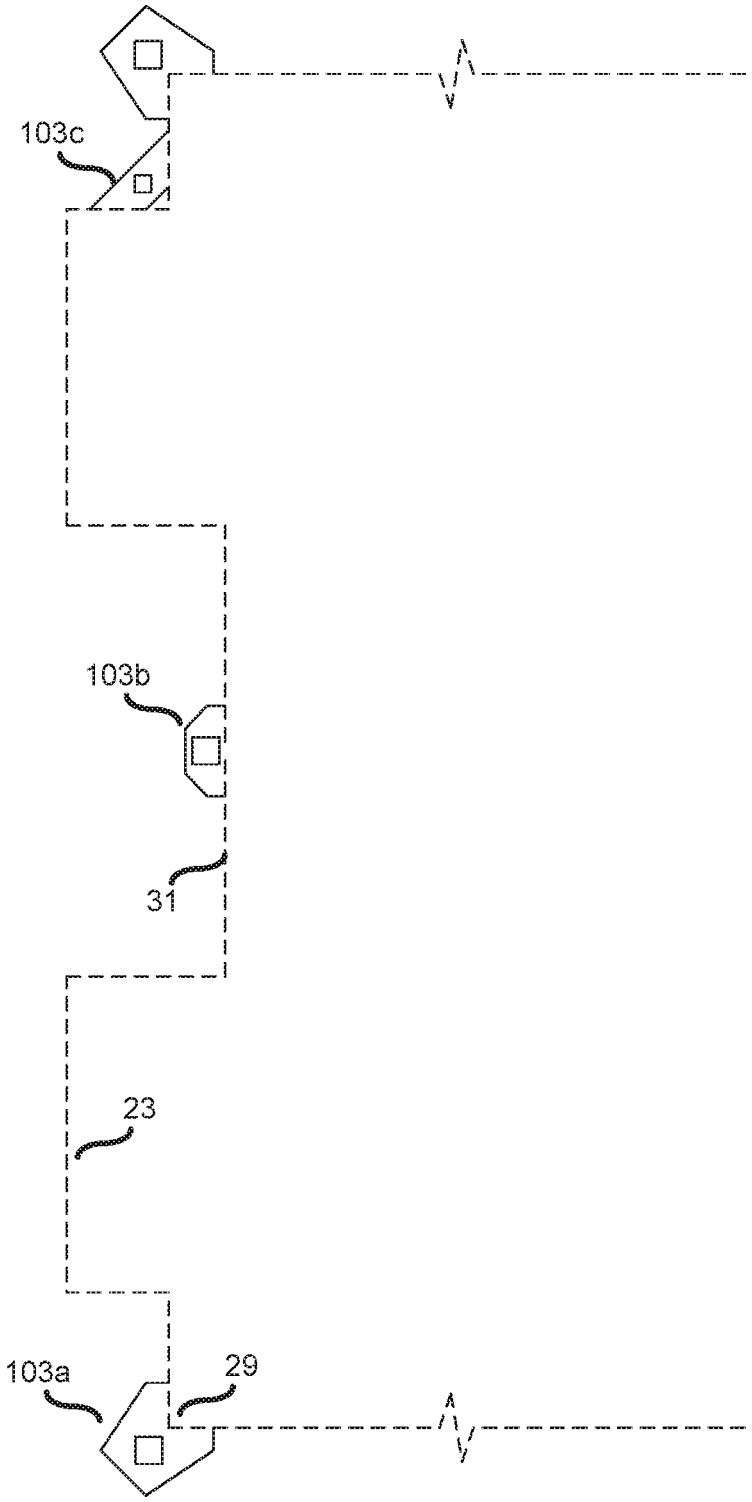
FIG. 5A illustrates aspects of a method of implementing a fall protection systems on an exterior of a structure under construction according to various embodiments of this disclosure.

FIGS. 5A-5D illustrate aspects of a fall protection system 101 according to certain embodiments of this disclosure. Referring to the non-limiting example of FIG. 5A, a wood or metal frame 23 can define an exterior of the unfinished structure 21, as shown. Depending on characteristics of the job site (for example, the degree of completion of the structure, and the availability of access to suitable anchor surfaces) towers 103 may be required to be positioned located only in or on a respective corner of the unfinished structure 21. However, in certain embodiments, suitable anchor surfaces fall protection system 101 are provided on the interior of the structure, or on a combination of interior and exterior surfaces. According to certain embodiments wood or metal frame 23 has outer or external corners 29 (as shown in FIGS. 5A and 5B) that are convex. In some embodiments (for example, embodiments as shown in FIGS. 5A, 5B, 7 and 8), the tower 103 can be located on the outer or external corner 29 of the wood or metal frame 23 of the unfinished structure 21. Referring to the non-limiting example of FIG. 5A, an instance of a tower 103*a* removably attached to an outside corner of the structure is shown, as is an instance of a tower 103*b* removably attached to a planar portion of the structure, and an instance of a tower 103*c* removably attached to an inside corner of the structure. According to certain embodiments, base 111 and the mount plate 151 can have concave portions 117, 157, respectively, that are configured to be complementary to and mate with, external corners 29 which are convex.

Referring to the non-limiting examples of FIGS. 5A, 5C, 7 and 8, a wood or metal frame 23 defines at least a portion of the exterior of the unfinished structure 21, and the wood or metal frame 23 can include external planar surfaces 31. According to certain embodiments, base 111 and mount plate 151 include planar portions 119, 159, respectively, which are configured to be complementary to and mate with, external planar surfaces 31. In various embodiments, planar portions 119, 159 abut with, and are fastened to the external planar surfaces 31. Put differently, in some embodiments, at least one of the towers 103 can laterally abut at least a portion of the planar, vertical wall of the wood or metal frame 23 of the unfinished structure 21, and not be on or in a corner thereof.

According to certain embodiments, (for example, certain embodiments as shown in FIGS. 5A and 5D), tower 103 can be located on an inner or concave corner of the wood or metal frame 23 of the unfinished structure 21. In various embodiments, the strength and support of the tower 103 required to provide fall protection is provided, at least in part by the wood or metal frame 23. According to some embodiments, by leveraging the structural strength of the building site itself, fall protection system 101 can be utilized across a broader range of construction sites than systems which rely on points away from the structure under construction for support.

Figure 3:
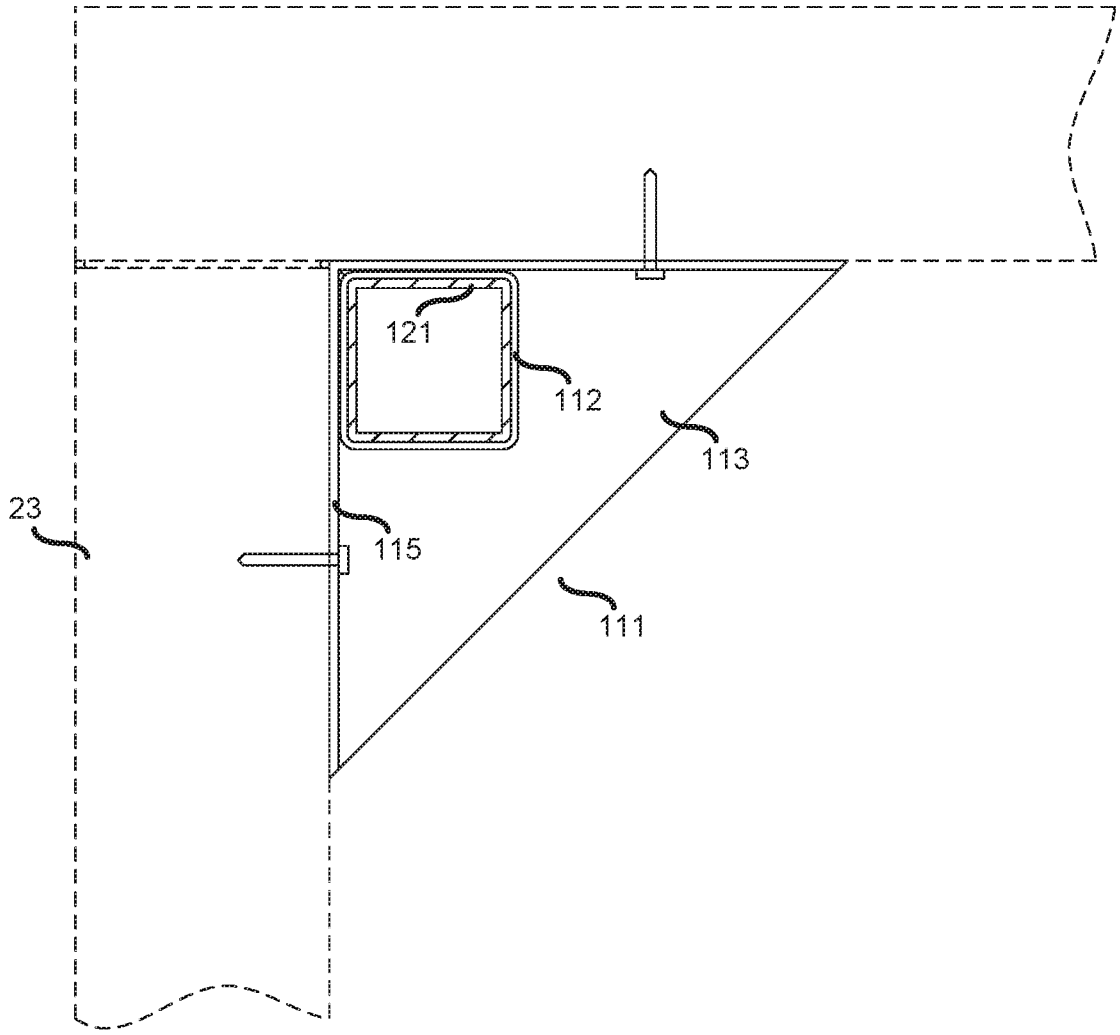
FIG. 3 illustrates a top view of a base plate for a fall protection system according to various embodiments of this disclosure.
Figure 4:
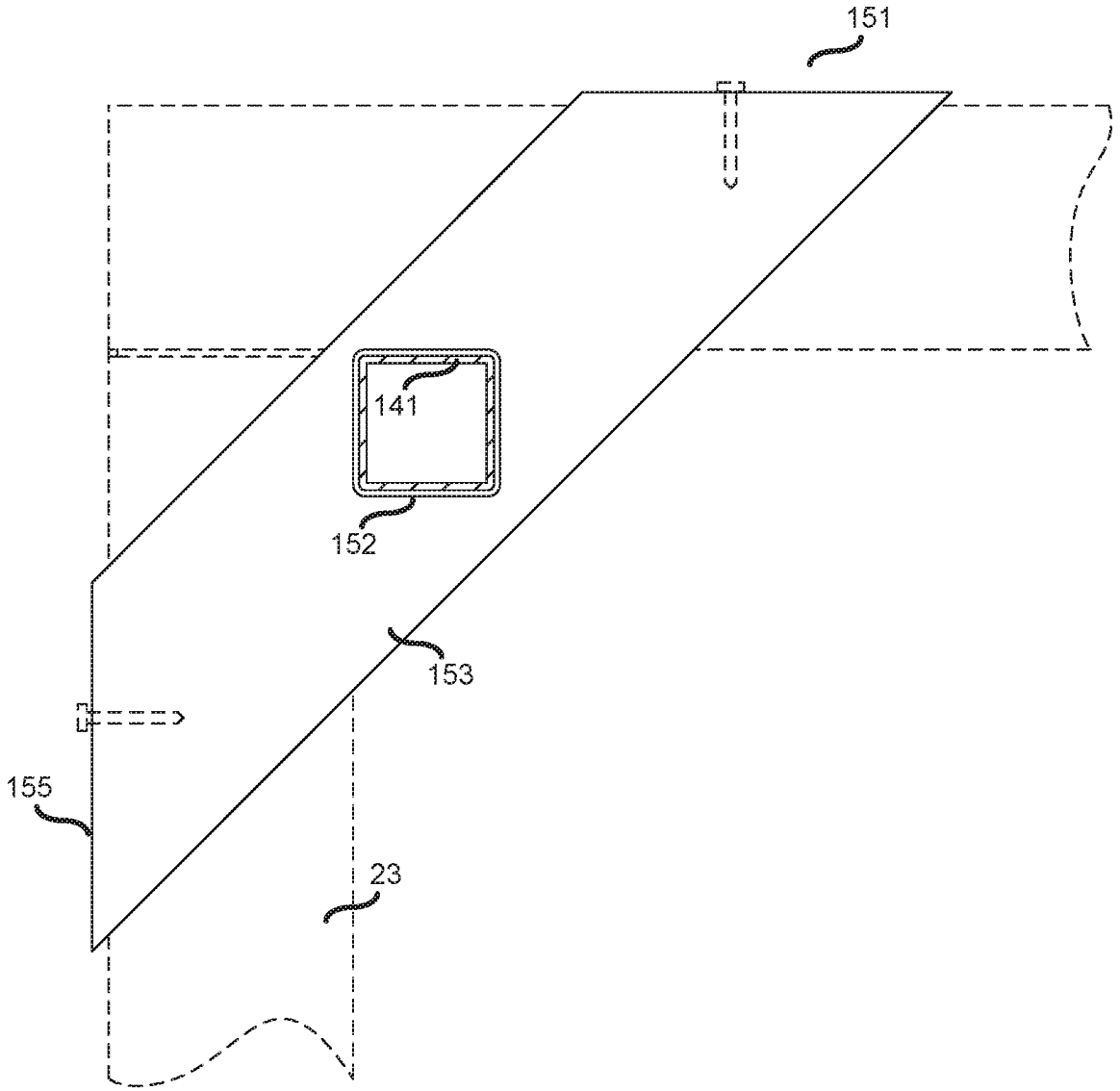
FIG. 4 illustrates a top view of a mount plate for a fall protection system according to certain embodiments of this disclosure.
Figure 6:
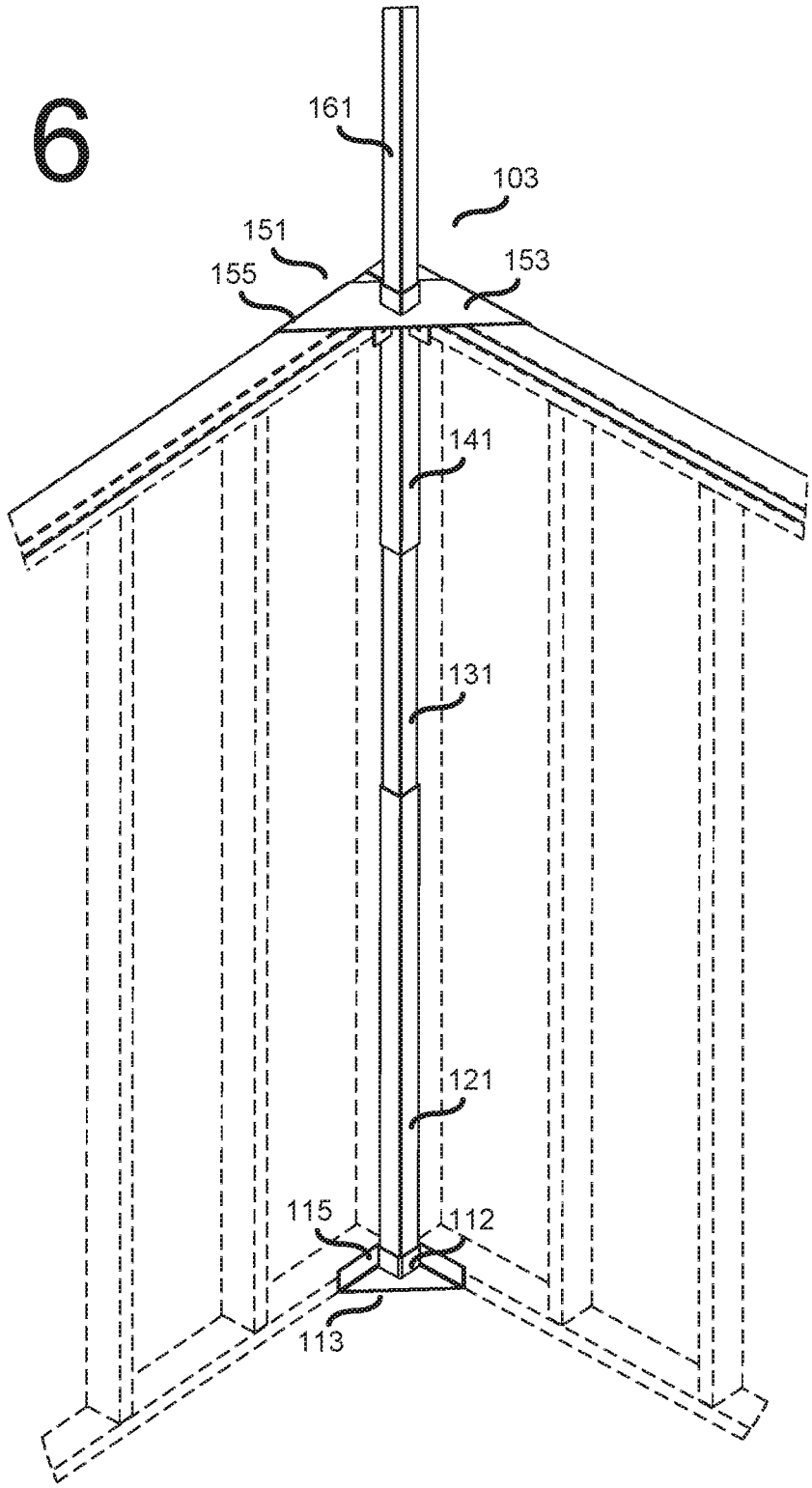
FIG. 6 illustrates, in isometric view, a fall protection system according to certain embodiments of this disclosure.
Figure 7:
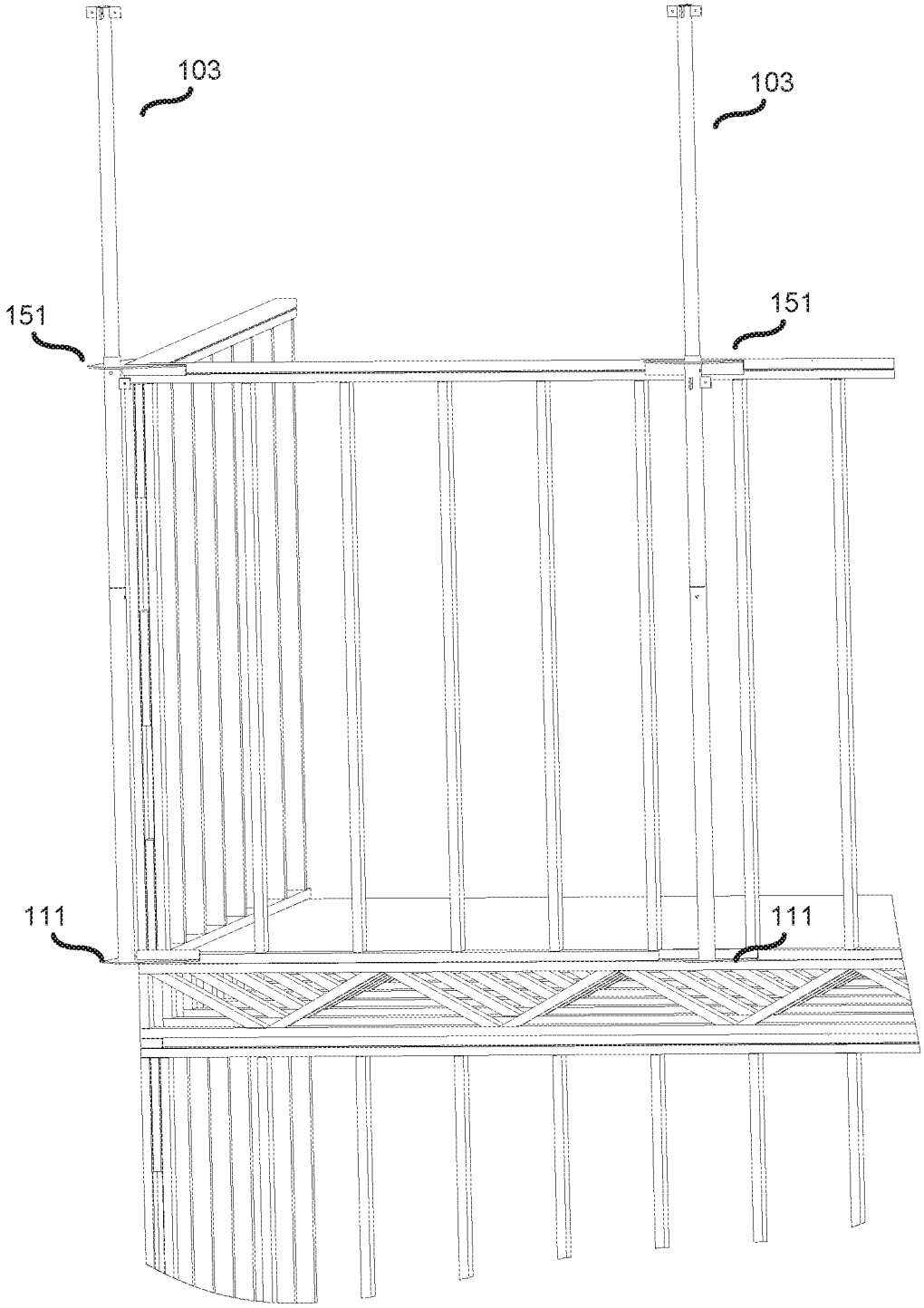
FIG. 7 illustrates, in isometric view, a fall protection system according to various embodiments of this disclosure.
Figure 8:
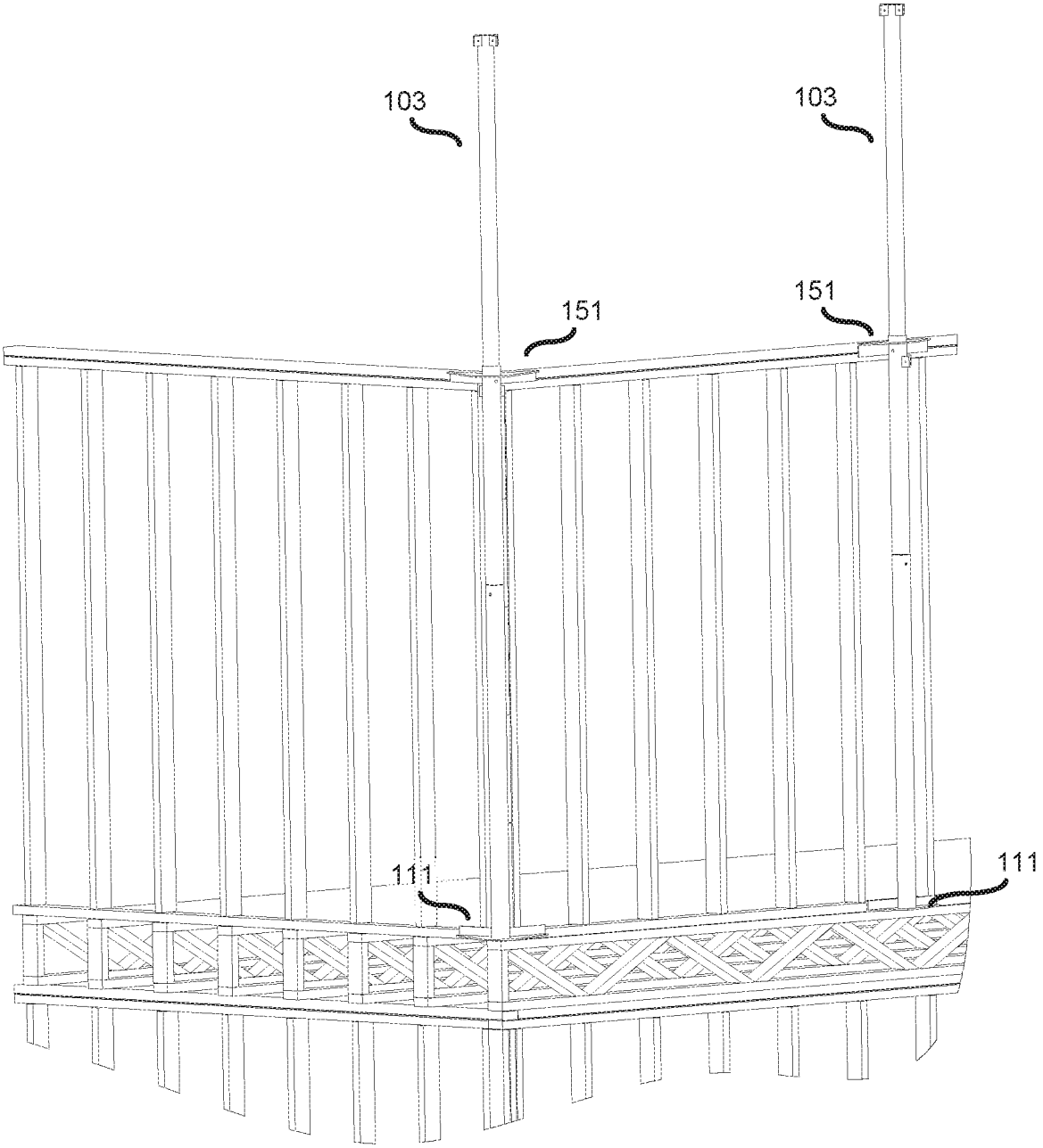
FIG. 8 illustrates a fall protection system according to various embodiments of this disclosure.

In some embodiments of the fall protection system 101, the base 111 has a generally triangular shape comprising a horizontal base plate 113 (FIGS. 1, 3 and 6). According to various embodiments, base 111 also includes vertical base plate portions 115 that extend (e.g., upward or downward) from the horizontal base plate 113. As shown in the non-limiting example of FIG. 1, the vertical base plate portions 115 are, in certain embodiments, configured to be fastened to the bottom 25 of the wood or metal frame 23.

Similarly, various embodiments of the mount plate 151 include a horizontal mount plate 153 (as shown, for example, in FIG. 6). In some embodiments, mount plate 151 includes vertical mount plate portions 155 that extend (e.g., downward) from the horizontal mount plate 153. The vertical mount plate portions 155 are, in some embodiments, configured to be fastened to the top 27 of the wood or metal frame 23. In additional or alternative embodiments, the base 111 and the mount plate 151 have any other appropriate shapes (i.e., rectangular, pyramidal, etc.) and wall configurations.

Figure 1B:
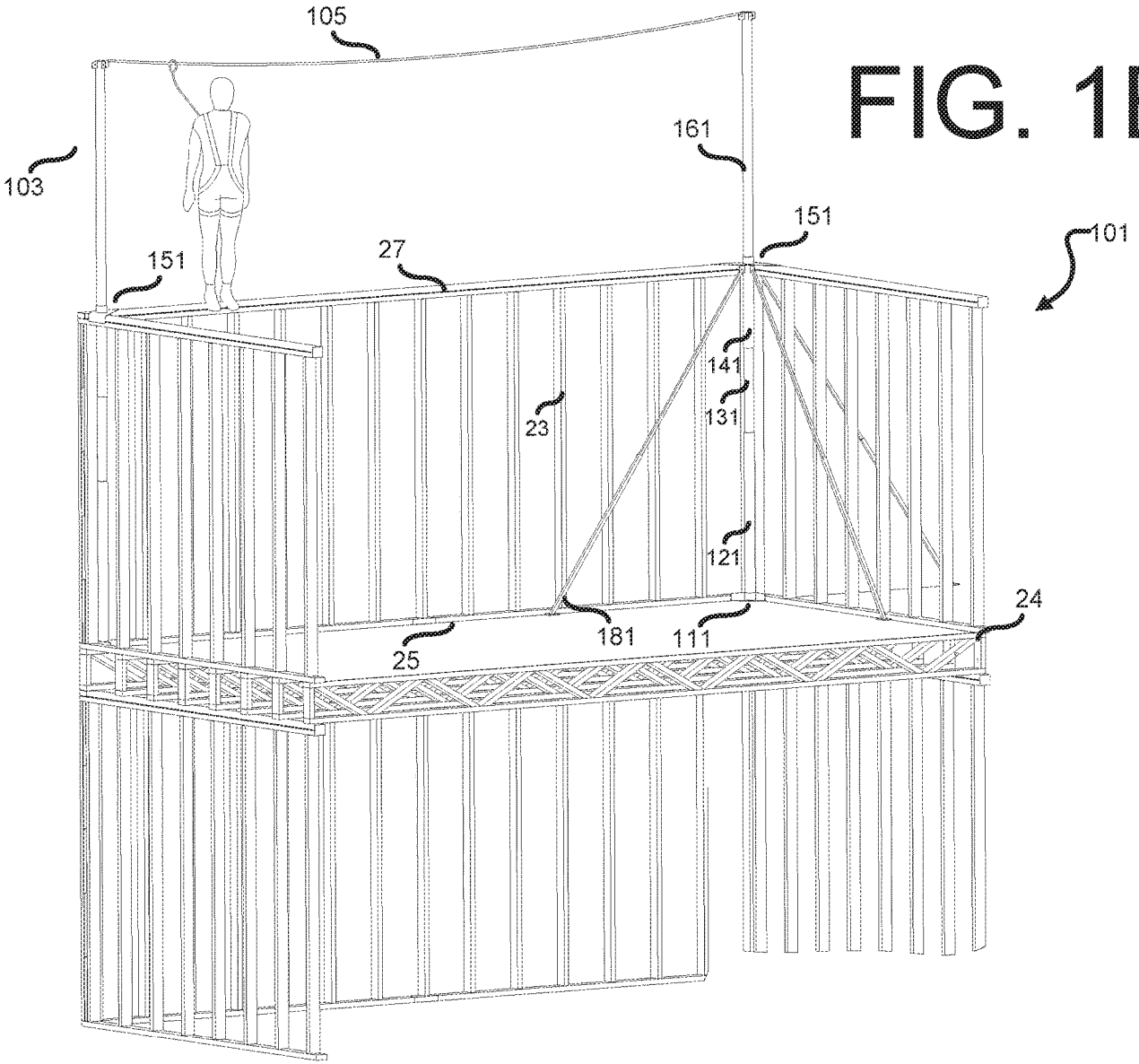
FIG. 1B illustrates a fall protection system according to various embodiments of this disclosure, as deployed on a second or higher floor of a building frame under construction.
Figure 2:
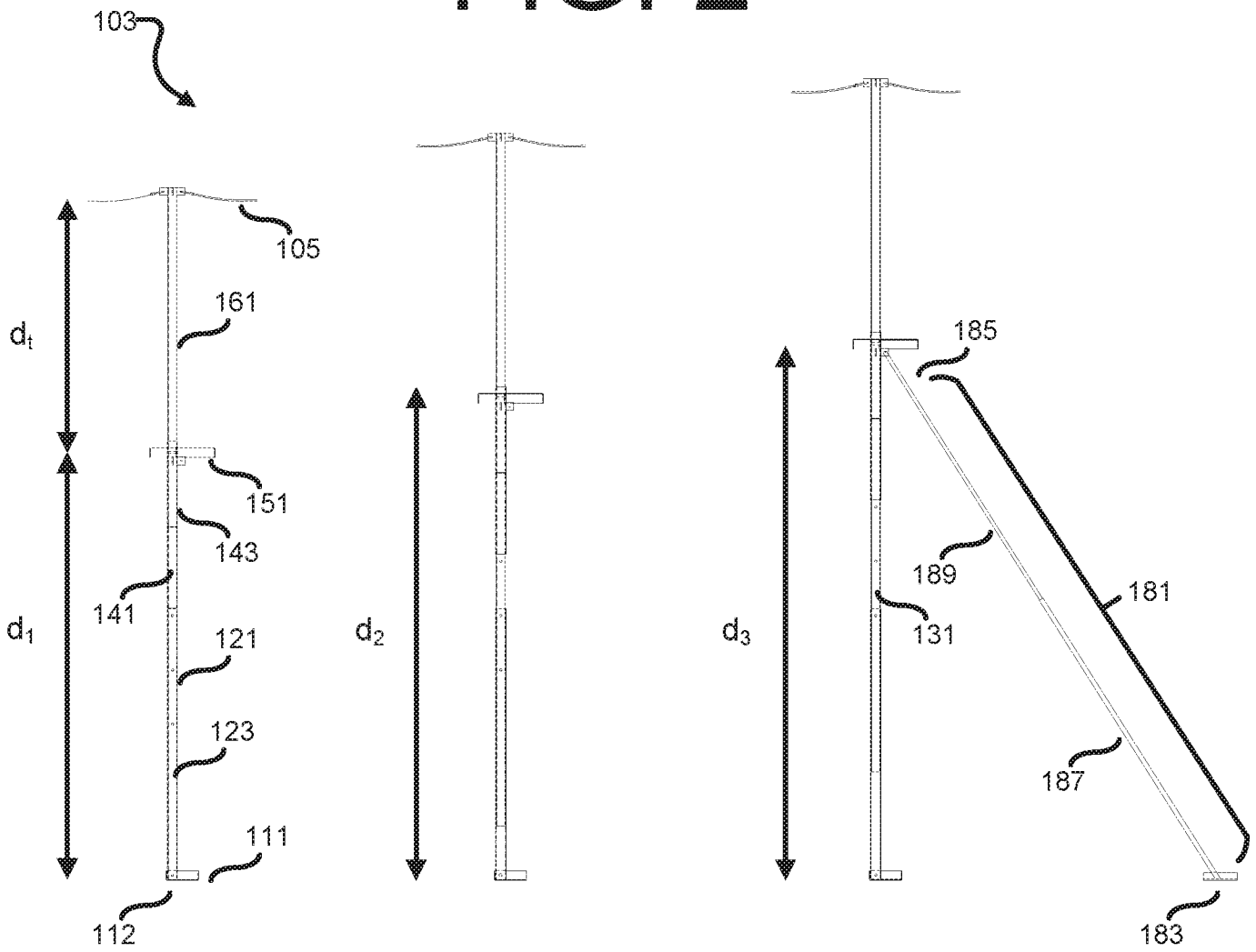
FIG. 2 illustrates a fall protection system according to some embodiments of this disclosure, as configured at first, second and third installation heights, respectively.

As depicted in the non-limiting examples shown in FIGS. 1A, 1B and 2, the fall protection system 101 can include one or more auxiliary support members 181. Auxiliary support member 181 is, in some embodiments, oriented at a diagonal relative to vertical and provides additional strength, in particular, resistance against cantilevering of stanchions 161, to the fall protection system 101. In certain embodiments, auxiliary support member 181 has a lower end 183 that is configured to be coupled to the bottom 25 of the wood or metal frame 23. Alternatively, the lower end 183 is configured to be mounted to the foundation of the unfinished structure 21. In various embodiments, lower end 183 comprises a sleeve for the bottom of auxiliary support member 181, analogous to sleeve 112 (FIG. 2) for the bottom of the lower slip sleeve 121. In certain embodiments, auxiliary support member 181 includes an upper end 185, which can be removably coupled or mounted (for example, on a pivot) to the upper slip sleeve 141 or to the mount plate 151. Referring to the non-limiting example of FIG. 2, a removable detent pin or clip may be used to secure auxiliary support member 181 to tower 103.

Some embodiments of auxiliary support member 181 comprise a slip sleeve, for example, a slip sleeve formed from square tubing. For example, in some embodiments, the slip sleeve includes a hollow rod 187, and an inner rod 189 which is configured to be slidably mounted in an interior of the hollow rod 187. In various embodiments inner rod 189 can be coupled to (for example, with a removable detent pin) hollow rod 187 to set a length of the auxiliary support member 181 to a selected length. The auxiliary support member 181 can be adjustable to support the tower 103 at its various vertical elevations, as described herein.

In the non-limiting example of FIG. 1A, a fall protection system 101 according to various embodiments of this disclosure, is shown installed on the ground floor or level (e.g., lowermost floor) of an unfinished structure 21. In the non-limiting example of FIG. 1B, a fall protection system 101 according to some embodiments, is shown installed on a floor (e.g., the second floor, the third floor, etc.) that is vertically above the ground floor of the unfinished structure 21. As illustrated in FIGS. 1A and 1B embodiments of the fall protection system 101 are attached to the wood or metal frame 23, rather than the foundation and/or any portion of the floor below which the fall protection system 101 is installed. By not requiring that fall protection system 101 be anchored to the foundation, the range of possible configurations and scenarios where fall protection system 101 is enhanced. As one non-limiting example, in certain embodiments, fall protection system 101 could be reinstalled upwards as additional floors are added to unfinished structure 21. According to various embodiments, such as, for example, embodiments as illustrated in FIG. 1B, the fall protection system 101 can be mounted to portions of the upper frame, such as ceiling/floor trusses or joists 24 that are located between floors or levels of the wood or metal frame 23.

Accordingly, embodiments of the fall protection system can be portable between floors of a building, as each floor of the building is being framed and constructed. In some embodiments of a method of using a fall protection system, the fall protection system can be installed on an initial floor or level of a frame of building, providing flexibility and extensibility to fall protection system 101. On that level, the fall protection system can provide fall protection for workers (FIG. 1A) that work at the top 27 of the wood or metal frame 23. When fall protection is no longer required or desired at that level of construction (e.g., framing is complete), and a next level of the building is ready to be added on top of that level, the fall protection system can be uninstalled from that level. The fall protection system can then be relocated to the next level and installed there, above the initial level. This installation and uninstallation sequence can be repeated until a top floor or a roof structure is added to the building.

According to various embodiments, the individual components of fall protection system 101 are constructed from metal (for example, steel or aluminum) tubing, or composite materials, making them relatively lightweight and portable. As used herein, the term "lightweight" encompasses weights which can be lifted and positioned for assembly by one or two workmen. According to various embodiments, the components of fall protection system 101 can assembled and disassembled by only one user (i.e., a single user) with components that are readily manipulated by the single user and formed into an assembly, and with commonly available hand tools (for example, socket wrenches, screwdrivers, or hex keys). According to certain embodiments, the total weight of fall protection is minimal, relative to that of unfinished structure 21, and can be supported through the natural bearing capacity of the frame of unfinished structure 21. According to various embodiments, fall protection system 101 is provided as a kit for construction safety. Accordingly, the single user can manually transport, install, uninstall and then further transport and install the kit at an upper level. In some versions, the total kit weight can be in a range of about 25 pounds to about 75 pounds. In contrast, certain existing fall protection systems are much heavier and require a machine (such as a fork lift) for transportation as well as installation.

As described herein, certain embodiments of fall protection system 101 configured to be coupled to the frame (also referred to herein as framing) of unfinished structure 21, such as at a residential or light commercial construction site. The framing can include a support structure (i.e., the ground or the floor); lower sole plates, upper top plates, and a plurality of vertical studs extending between the upper and lower plates. The lower and upper plates can be coupled at corners of the frame. Versions of the frame can include joists and/or joist trusses, as well as roof trusses or rafters, as is known in the art. In additional or alternative embodiments, the frame may have other configurations.

The fall protection system can includes a first fall protection device (e.g., tower) and a second fall protection device. The first and second fall protection devices can be the same or different. Accordingly, the description of one of the first and second fall protection devices can apply to both. The various components of the towers of the fall protection system can be moved or slide relative to each other to adjust the overall length. Likewise, the first and second fall protection devices can further include one or more diagonal, auxiliary support members.

Embodiments of the first fall protection device can be positioned adjacent to one portion (i.e., a corner) of the frame and the second fall protection device can be positioned adjacent another portion (i.e., another corner) of the frame. In particular, the first and second fall protection devices can extend along a vertical elevation of the frame adjacent the corners, while the stanchions extend above them. A first end of one lifeline can be secured to the stanchion of the first fall protection device, and a second end of the lifeline can be coupled to the stanchion for the second fall protection device. The lifeline extends between the first and second fall devices. In this way, a user couples to the lifeline such that, in the event of a fall, the user is captured by the lifeline and fall protection system and the probability of injury is reduced.

In other embodiments of a method of using the fall protection system, a user can position the first fall protection device adjacent to the frame, secure the base of the first fall protection device to the support structure, and secure the mount plate of the first fall protection device to a portion of the frame. The user also can couple the first end of the lifeline to the stanchion of the first fall protection device. The user can further position the second fall protection device adjacent to the frame, secure the base of the second fall protection device to the support structure, and secure the mount plate of the second fall protection device to another portion of the frame. The user can further couple the first end of the lifeline of the second fall protection device to the stanchion.

Positioning the second fall protection device can include positioning the second fall protection device at a desired distance from the first protection device. Additionally, securing the mount plate of each of the first and second fall protection devices to the frame can include securing each mount plate at a distance of 8 feet, 9 feet, or 10 feet from the respective base. The fall protection system is shown and described as being used at a residential or light commercial construction site. It is, however, within the scope of this disclosure that the fall protection system may be used at other types of construction sites as well.

In some particular examples, the fall protection system can be designed for use where the total weight of the supported user and equipment (e.g., tools) is 310 pounds or less, or up to 420 pounds under ANSI Z359 series using proper harness(es) and lifeline(s). The system can use exterior and/or interior wood or metal-framed building corners, as well as an intermediate stanchion using either exterior or interior wall surfaces. Versions of the corner brackets and intermediate brackets can use a sliding collar configuration. The bottom bracket can have a closed bottom section to limit the stanchion from going through the collar. The upper bracket can have an open collar, allowing the stanchion to extend through the collar.

Certain embodiments of fall protection system 101 are designed to interface with, and be dimensionally compatible with wood or metal frame construction using standard construction techniques, such as construction standards wherein studs are on 16-inch centers or less. Further examples of standard construction dimensions with which embodiments of fall protection system 101 are structurally and dimensionally compatible include wood framing using Number 3 SYP or better, or Spruce Pine Fir (SPF) material. According to various embodiments, fall protection system 101 is configured to be attachable to metal framing, which can include commonly utilized cold rolled metal studs and track materials. The fall protection system can be mounted either external to the building, reducing interference between the system and the framing operation(s), or internally. When the fall protection system is mounted on the exterior of the building for use by (for example) floor joist crew, it also can be used by the floor decking crew for their edge fall protection. Further, the fall protection system can be used by the wall framing crew while they build and install the exterior wall units of the building, such that the exterior wall units then become support for their fall protection, or negate the need for additional fall protection.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and FIGS. are to be regarded in an illustrative rather than a restrictive sense, and all such modifications are intended to be included within the scope of invention.

It may be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 112(f).

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A fall protection system comprising:

one or more towers configured to support a lifeline, each tower comprising:

a base configured to be removably coupled to a lower portion of a frame of a structure;

a lower slip sleeve configured to be slidably coupled to the base, the lower slip sleeve comprising an elongated opening extending substantially therethrough;

an internal piece configured to be slidably received in the elongated opening and coupled to the lower slip sleeve;

an upper slip sleeve coupled to an exterior of the internal piece, the upper slip sleeve comprising an upper elongated opening extending to the internal piece;

a mount plate configured to be slidably coupled to an exterior of the upper slip sleeve and further configured to be removably coupled to an upper portion of the frame of the structure; and a stanchion configured to be slidably received in the upper elongated opening and coupled to the upper slip sleeve, the stanchion further configured to support an end of the lifeline.

2. The fall protection system of claim 1, wherein the internal piece, the upper slip sleeve, the mount plate, and the stanchion are configured to be movable together with respect to the lower slip sleeve to adjust a vertical elevation of an anchor point between the stanchion and the lifeline.

3. The fall protection system of claim 1, wherein the base is removably coupled to one or more of an inside corner, a planar portion or an outside corner of the structure.

4. The fall protection system of claim 1, wherein the mount plate is removably coupled to one or more of an inside corner, a planar portion or an outside corner of the structure.

5. The fall protection system of claim 1, comprising an auxiliary support member.

6. The fall protection system of claim 5, wherein the auxiliary support member comprises a lower end configured to be coupled to the frame of the structure, and an upper end extending diagonally relative to vertical and coupled to the upper slip sleeve.

7. The fall protection system of claim 6, wherein the auxiliary support member comprises a slip sleeve having a hollow rod, and an inner rod configured to be slidably mounted in an interior of the hollow rod and coupled to the hollow rod.

8. The fall protection system of claim 1, further comprising detent pins configured to adjustably couple the lower slip sleeve to the internal piece, and the upper slip sleeve to the stanchion, respectively.

9. The fall protection system of claim 1, wherein the fall protection system comprises no tensioning cables.

10. The fall protection system of claim 1, wherein the fall protection system is not fastened to a concrete foundation of the structure, and the fall protection system is coupled only to the frame to secure the fall protection system to the structure.

11. The fall protection system of claim 1, wherein the base comprises a vertical sleeve in which the lower slip sleeve is configured to be mounted, and the mount plate comprises a hole through which the upper slip sleeve is configured to extend.

12. The fall protection system of claim 1, wherein the fall protection system is configured to withstand a downward force of 310 pounds or more applied to a point on a lifeline connected to one or more stanchions of the fall protection system.

13. The fall protection system of claim 1, wherein the fall protection system is configured to be removably coupled to metal framing of the structure.

14. The fall protection system of claim 1, wherein one or more of the base and the mount plate comprise concave portions, respectively, which are configured to be complementary to and mate with convex corners of the structure.

15. The fall protection system of claim 1, wherein one or more of the base and the mount plate comprise planar portions, respectively, that are configured to be complementary to and mate with planar surfaces of the structure.

16. The fall protection system of claim 1, wherein the base comprises a horizontal base plate and vertical base plate portions extending upward therefrom, and the vertical base plate portions are configured to be fastened to the frame.

17. The fall protection system of claim 1, wherein the mount plate comprises a horizontal mount plate and vertical mount plate portions extending downward therefrom, and the vertical mount plate portions are configured to be fastened to the frame.

18. The fall protection system of claim 1, wherein the fall protection system comprises a portable kit which can be assembled using one or more hand tools.

19. The fall protection system of claim 18, wherein the one or more hand tools comprise one or more of an Allen key, a screwdriver, a crescent wrench or a socket wrench.

* * * * *